United States Patent [19]

Kawabata et al.

[11] Patent Number: 4,510,745

[45] Date of Patent: Apr. 16, 1985

[54] OPEN-END SPINNING UNIT

[75] Inventors: Susumu Kawabata, Aichi; Tetsuzo Inoue, Nagoya; Noriaki Miyamoto, Toyota; Masanobu Shibuya, Kariya; Masashi Kaneko, Tokai, all of Japan

[73] Assignees: Kabushiki Kaisha Toyota Chuo Kenkyusho; Kabushiki Kaisha Toyoda Jidoshokki Seisakusho, both of Aichi, Japan

[21] Appl. No.: 506,327

[22] Filed: Jun. 21, 1983

[30] Foreign Application Priority Data

Jun. 21, 1982 [JP] Japan ..... 57-105471

[51] Int. Cl.[3] ..... D01H 7/882; D01H 7/898

[52] U.S. Cl. ..... 57/415; 57/414; 57/302

[58] Field of Search ..... 57/411, 414, 415, 301, 57/302

[56] References Cited

U.S. PATENT DOCUMENTS 3,845,612 11/1974 Chisholm et al. ..... 57/415 X 3,859,779 1/1975 Furstenberg ..... 57/415

*Primary Examiner*—John Petrakes

*Attorney, Agent, or Firm*—Burgess, Ryan & Wayne

[57] ABSTRACT

An open-end spinning unit is provided which has a spinning rotor open on one side and a bottom wall and an inner wall. A closing element covers the open side of the rotor and includes a fiber supply duct. To enhance the air conveyance of fibers to the inner wall, at least one suction opening is provided downstream of an outlet opening of the fiber supply duct in the closing element so that an airstream directed from the outlet opening toward the suction opening is generated in the same direction as the direction of rotation of the rotor. This invention is applicable not only to a forced-exhaustion type of unit but also to a self-exhaustion type of unit.

9 Claims, 11 Drawing Figures

OPEN-END SPINNING UNIT

BACKGROUND OF THE INVENTION

1. Field of the Invention

The invention relates to an open-end spinning unit. More specifically, it relates to an improvement in the conveyance of fiber by a rotor-type open-end spinning unit from the fiber supply duct thereof to a fiber-collecting groove thereof.

2. Description of the Prior Art

The drawbacks of the prior art are explained below with reference to FIGS. 1 to 4.

In the conventional rotor-type open-end spinning unit shown in FIG. 1, a sliver 3 supplied through an inlet 2 of the unit 1 is guided to a combing roller 6 by a feed roller 4 and a presser 5, by which the sliver 3 is pressed onto the feed roller 4. Then the sliver 3 is opened into individual fibers by the combing roller 6, and, at the same time, foreign matter 7 such as leaves and trash are expelled through an outlet 8. Thereafter, the opened fibers are transported to a spinning chamber 10 of a rotor 9 through a fiber supply duct 11 by an airstream created by a subatmospheric pressure in the chamber 10. The fibers thus transported into the chamber 10 reach an inner wall 9*a* of the rotor 9 and are maintained thereon by a centrifugal force imparted thereby by the rotor 9. Then the fibers slide toward a fiber-collecting groove 13, in which the fibers are collected in the shape of a ribbon. The fiber ribbon is drawn out, through a yarn guide hole 14, of the chamber 10 while it rotates and thereby is twisted to form a yarn.

The spinning chamber 10 is defined by an inner space of the rotor 9 in a cup-shape having the inner wall 9*a* and a bottom wall 9*b*. An open space of the rotor is substantially closed by a closing component 20 formed by part of the frame of the spinning unit 1. The component 20 projects into the rotor 9 as a frustum-shaped portion 20*a* on a side wall of which outlet opening 11*a* of the fiber supply duct 11 is provided.

There are two types of exhaustion in the spinning chamber 10 for obtaining a subatmospheric pressure therein. One type is forced exhaustion, in which the air in the chamber 10 is sucked out through a clearance between the closing component 20 and the rotor 9 by a suction means (not shown) connected to an outlet 16 on a housing 15 covering all of the rotor 9. The other type is a self-exhaustion, in which the air in the chamber 10 is expelled through a plurality of apertures (not shown) provided radially on the bottom wall 9*b* of the rotor 9 by a centrifugal force imparted by the rotor 9. It is desirable in both types of exhaustion that the fibers transported into the chamber 10 through the fiber supply duct 11 be immediately transferred from an airstream 12 of the duct 11 to a vortex whirling in the vicinity of the inner wall 9*a* so that they can reach the inner wall 9*a* as soon as possible. In the conventional spinning unit, however, some of the fibers often fail to smoothly reach the vortex. Such fibers float in a vacant space of the spinning chamber 10 and are finally folded into a fiber bundle which is drawn out through the yarn guide hole 14, resulting in a slubby yarn. Even if the fibers reach the inner wall 9*a*, they tend to deposit in a disordered state in the fiber-collecting groove 13 and result in a weak yarn.

The above-mentioned problems are due to the pressure distribution and velocity distribution of the vortex in the spinning chamber 10.

According to an investigation made by the present inventors, the static pressure in the chamber 10 in the case of self-exhaustion is low near the center of the rotor 9 and sharply increases toward the inner wall 9*a* as shown in FIG. 2. Therefore, the fibers transported into the spinning chamber 10 from the fiber supply duct 11 tend to be sucked toward the center of the rotor 9 rather than toward inner wall 9*a*.

This tendency also exists in the spinning chamber 10 in the case of forced exhaustion. As is shown in FIG. 3, though the pressure distribution in the case of forced exhaustion is considerable equalized compared to that in the case of self-exhaustion, the highest pressure point is in the vicinity of the inner wall 9*a*.

In addition to the abovesaid pressure distribution, the vortex generated as a concomitant flow of the rotor 9 in high-speed rotation is effective only a short distance from the inner wall 9*a* because the velocity thereof sharply decreases as the distance from the inner wall 9*a* increases, as is shown in FIG. 4. Thus, the fibers transported into the spinning chamber 10 through the fiber supply duct 11 are halted midway between the opening 11*a* and the inner wall 9*a*, resulting in a plurality of floating fibers or bent fibers among the transported fibers. These floating or bent fibers cannot be restored to their original straight state even if they are subjected to the stretching action of the vortex prior to their arrival at the inner wall 9*a*. Therefore, the resultant yarn is both weak in strength and poor in appearance.

SUMMARY OF THE INVENTION

It is an object of the present invention to eliminate the aforesaid drawbacks in the conventional spinning unit.

It is another object of the present invention to provide an open-end spinning unit in which fibers transported into a spinning chamber through a fiber supply duct can immediately reach an inner wall of a rotor without moving about within the spinning chamber, thereby producing a good quality yarn.

The abovesaid objects can be achieved by an open-end spinning unit provided with a spinning rotor open on one side and having a bottom wall and an inner wall, the open side being covered with a closing element containing a fiber supply duct having an outlet opening in the closing element, in which at least one suction opening is disposed downstream, relative to the rotation of the rotor, of the outlet opening of the fiber supply duct, whereby an airstream directed in the same direction as the rotation of the rotor is generated from the outlet opening to the suction opening.

BRIEF DESCRIPTION OF THE DRAWINGS

The present invention is explained in detail with reference to the accompanying drawings, wherein.

DESCRIPTION OF THE PREFERRED EMBODIMENTS

Figure 1:
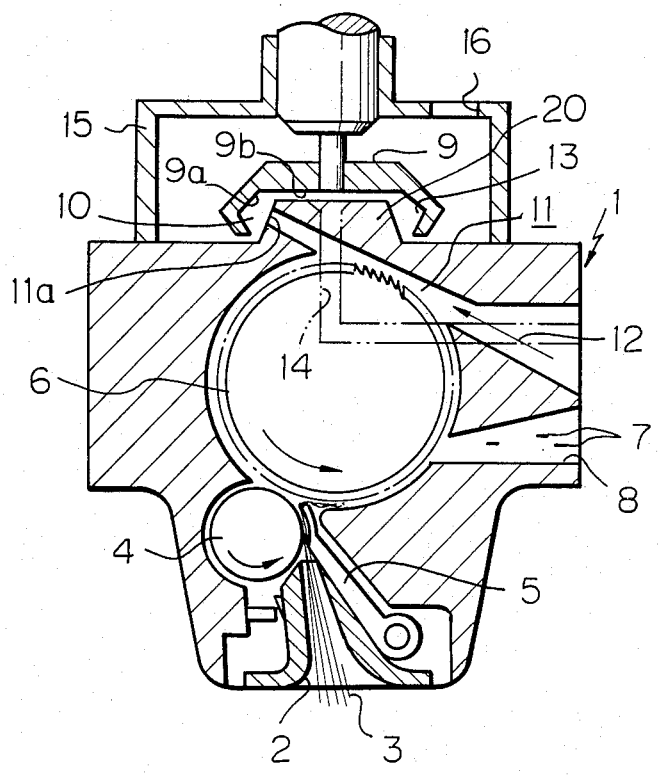
Fig. 1 PRIOR ART
FIG. 1 is a sectional side view of a conventional open-end, forced-exhaustion type of spinning unit.
Figure 2:
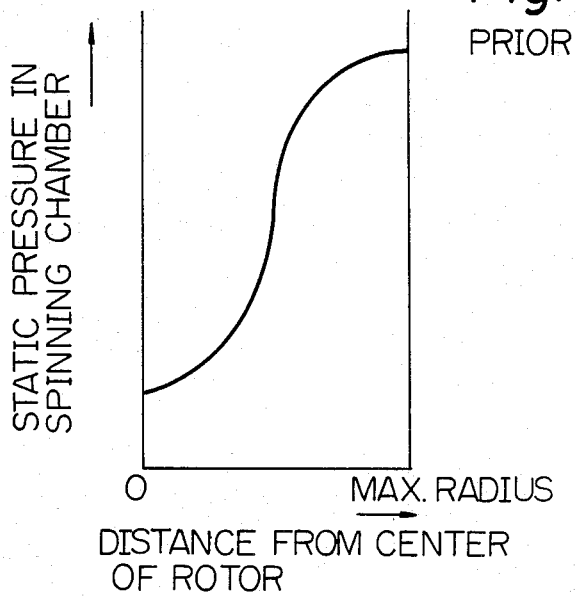
Fig. 2 PRIOR ART
FIGS. 2 and 3 are graphs showing the static pressure distribution in a self-exhaustion type of spinning chamber and in a forced-exhaustion type of spinning chamber, respectively.
Figure 3:
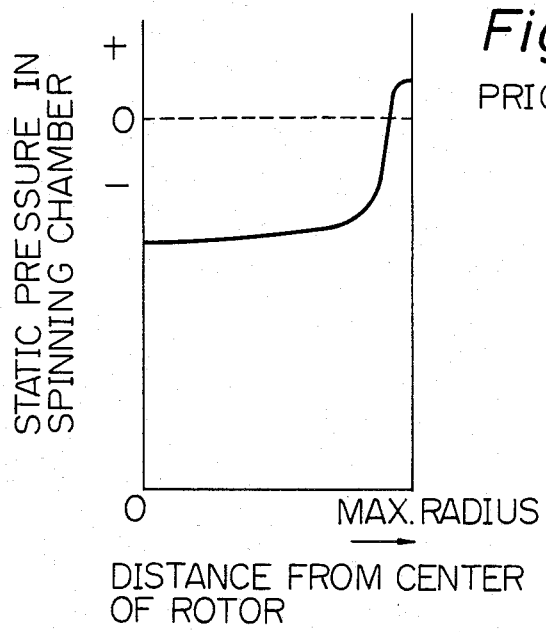
Fig. 3 PRIOR ART
Figure 4:
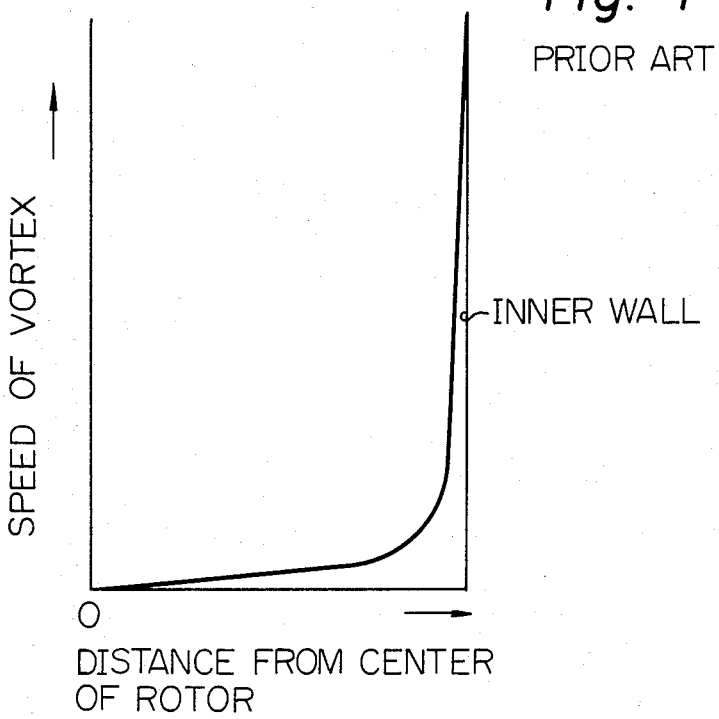
Fig. 4 PRIOR ART
FIG. 4 is a graph showing the velocity distribution of a vortex in a forced-exhaustion type of spinning chamber.
Figure 5:
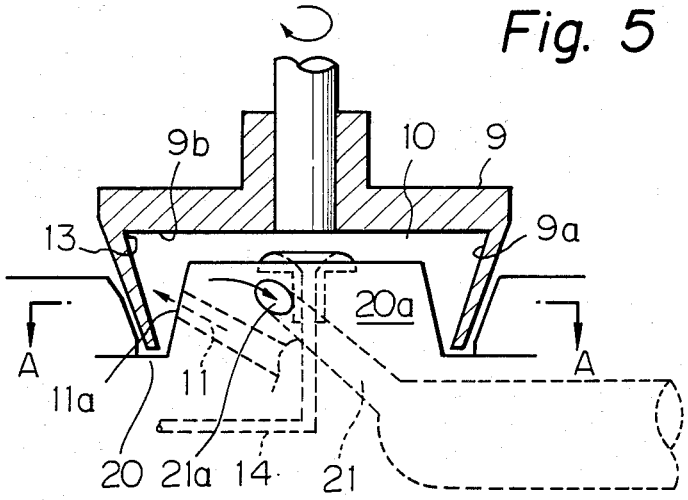
FIG. 5 is a fragmental sectional side view of a spinning view according to a first embodiment of the present invention.
Figure 6:
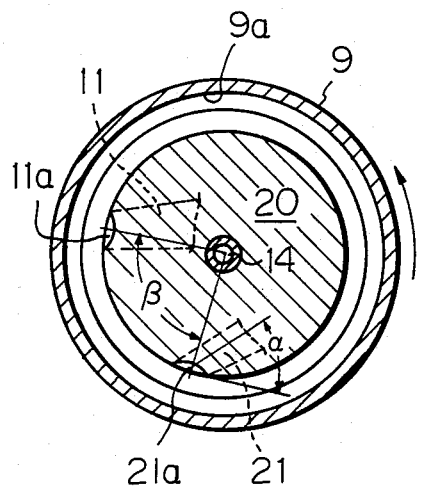
FIG. 6 is a sectional plan view of the first embodiment along the line A—A in FIG. 5.

A first embodiment of the present invention is illustrated in FIGS. 5 and 6. In the figures, a fiber supply duct 11, similar to a conventional fiber supply duct, is provided in a side wall of a frustum-shaped portion 20*a* of a closing element 20 in such a manner that the direction of the duct 11 at an outlet opening 11*a* deviates from the radial direction of the rotor 9 so as to point in the rotational direction of the rotor 9. Due to this structure, a first airstream introduced into the spinning chamber 10 from the opening 11*a* can accelerate a concomitant vortex generated inside the rotor 9 by the high-speed rotation thereof. The fibers transported into the spinning chamber 10 should be transferred immediately from the airstream from the duct 11 to the concomitant vortex without deceleration of the speed thereof. However, as was mentioned before, it is very difficult to realize such an ideal state because the fibers tend to be bent due to divergency and deceralation of the first airstream conveying them into the spinning chamber 10, caused by the pressure distribution and the velocity distribution therein.

To improve this point, the inventive spinning unit is provided with an opening 21*a* of a suction duct 21 connected to a suction source (not shown), on the side wall of the projected portion 20*a* of the closing element 20. The opening 21*a* is disposed downstream, in relation to the rotational direction of the rotor 9, of the opening 11*a* of the duct 11. Due to this structure, a second vortex is forcibly generated from the opening 11*a* to the opening 21*a* in the chamber 10. Since the flowing direction of the second vortex is the same as that of the concomitant vortex, it is gradually accelerated by the concomitant vortex and smoothly joins thereto.

The fibers transported into the chamber 10 by the first airstream are transferred to the second vortex, in which the fibers are subjected to a circumferential force caused by the acceleration of the second vortex and are stretched along the longitudinal direction thereof. Since a centrifugal force which makes the fibers flow radially outward exerts on the fibers at the same time, the fibers are forced to obliquely cross a space of the spinning chamber between the opening 11*a* and the inner wall 9*a*, and, thereby, are smoothly transferred to an area of the concomitant vortex without abrupt deceleration of the the velocity of the fibers. Thus, the fibers can be deposited on the inner wall 9*a* while maintaining a straight state, and thereby a good mechanical strength is imparted to the resultant yarn.

The opening 21*a* of the suction duct 21, as shown in FIG. 6, preferably inclines to oppose the direction of rotation of the rotor 9 so that the second vortex from the opening 11*a* of the fiber supply duct 11 can be effectively received into the opening 21*a*.

That is, the suction opening 21*a* is provided on the side wall of the projected portion 20*a* in such a manner that a tangent in the rotational direction of the rotor 9 to an imaginary circle encircling the side wall at the suction opening 21*a* makes an acute angle $\alpha$ relative to an axis of the opening 21*a*.

An angular distance $\beta$ between the openings 11*a* and 21*a* is preferably more than 45 degrees around the center axis of the closing element 20 as shown in FIG. 6.

Figure 7:
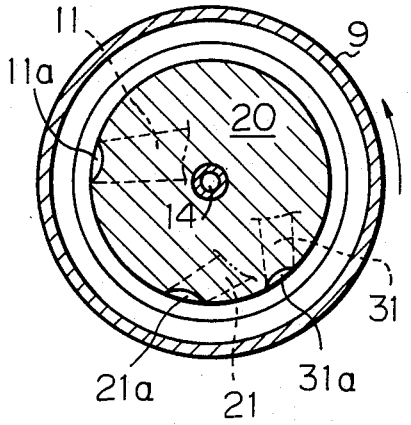
FIG. 7 is a sectional plan view of a spinning unit according to a second embodiment of the present invention.

FIG. 7 illustrates a second embodiment of the present invention which has, in addition to the abovesaid suction duct 21 and the opening 21*a*, another suction duct 31 and an opening 31*a* thereof provided in the side wall of the frustum-shaped portion 20*a* downstream of the opening 21*a*. Due to the additional opening 31*a*, the second vortex is enhanced and transfer of the fibers is smoother.

Figure 8:
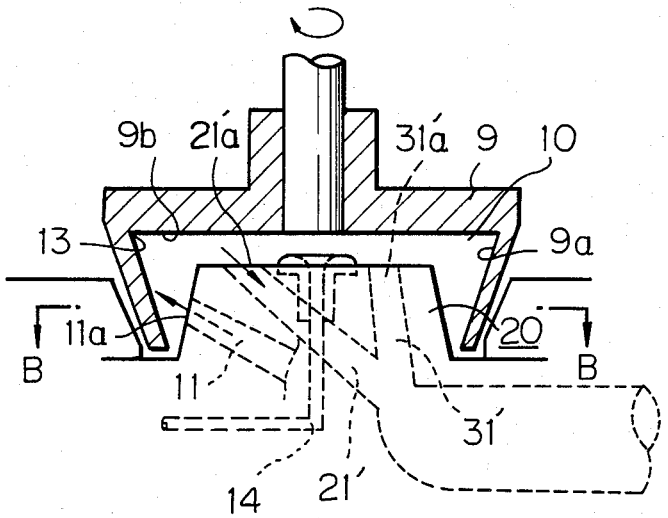
FIGS. 8 and 9 are a sectional side view and a sectional plan view, respectively, of a spinning unit according to a third embodiment of the present invention.
Figure 9:
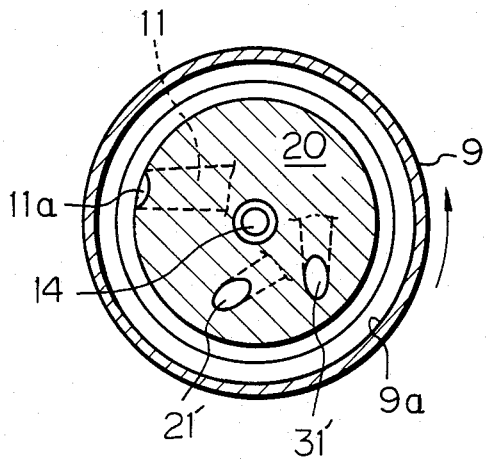

FIGS. 8 and 9 illustrate a third embodiment of the present invention in which two openings 21'*a* and 31'*a* are provided in the top wall, rather than in the side wall as in the second embodiment, of the frustum-shaped portion 20*a* and are communicated with a suction source (not shown) through suction ducts 21' and 31', respectively. The functions of the third embodiment are substantially the same as those of the second embodiment.

Figure 10:
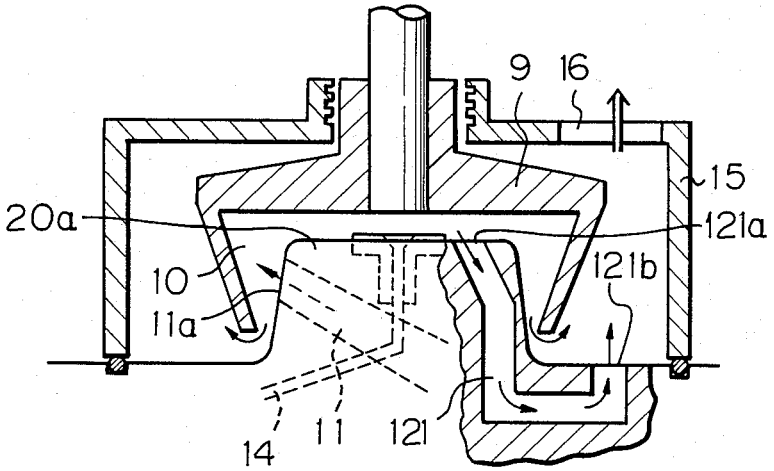
FIG. 10 is a sectional side view of a spinning unit according to a fourth embodiment of the present invention.

FIG. 10 illustrates a fourth embodiment of the present invention. In this embodiment, a suction duct 121 is provided in such a manner that an inlet opening 121*a* is in the top wall of the frustum-shaped portion 20*a* and an outlet opening 121*b* opens into the interior of a housing 15 covering the rotor 9. A suction flow is generated in the duct 121 by means of a suction source (not shown) utilized for forced exhaustion of the spinning chamber 10 through an outlet 16 of the housing 15. In this case, the suction force of the duct 121 may be controlled by adjusting the proportion of air sucked out through a clearance between the portion 20*a* and the inner wall 9*a* of the rotor 9 to the total amount of sucked-out air.

Figure 11:
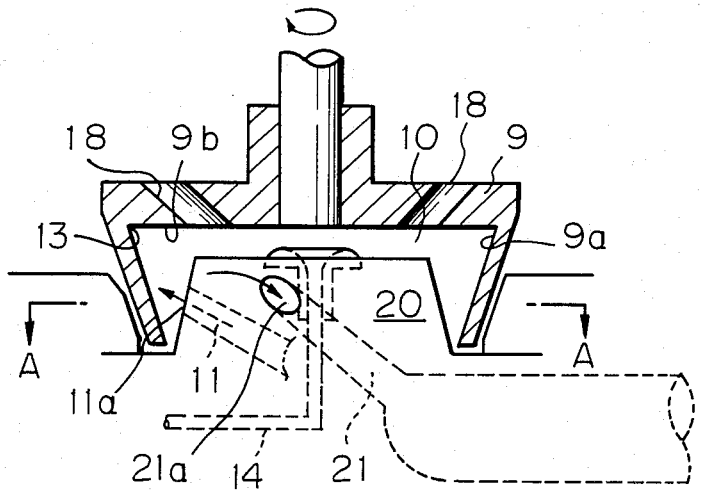
FIG. 11 is a sectional side view of a spinning unit according to a fifth embodiment of the present invention.

The present invention is applicable to a self-exhaustion type of spinning unit as shown in FIG. 11, in which spinning unit apertures 18 are provided in the bottom wall 9*b* for discharging air in the chamber 10.

Further, the present invention is effective on a combination type of spinning unit (not shown) in which both of a self-exhaustion and a forced-exhaustion are adopted.

The total cross-sectional areas of the suction openings are preferably larger than the cross-sectional area of the outlet opening of the fiber supply duct. The degree of vacuum in the spinning chamber is preferably within a range of from −500 mm to −1,000 mm Aq. This value corresponds to a volume of exhausted air of from 2 l/sec. to 5 l/sec. when applied to a practical spinning unit. Further, more than three suction openings may be provided if necessary, and any desired shape thereof may be selected.

As was described above, according to the present invention, fibers transported into a spinning chamber of a rotor can be smoothly deposited on an inner wall of the rotor without being bent due to the influence of a second vortex generated by a newly provided suction opening or openings downstream of an opening of a fiber supply duct. The provision of the suction opening or openings also decreases the number of floating fibers which are not transferred to a concomitant vortex and which can possibly be irregularly twisted into a fiber bundle drawn out from the spinning chamber. As a result, the strength and the evenness of the resultant yarn is greatly improved.

We claim:

1. An open-end spinning unit comprising a spinning rotor open on one side thereof and having a bottom wall and an inner wall which define a chamber; and a closing element covering the open side of the rotor and containing a fiber supply duct having an utlet opening which opens into the chamber of said closing element, and at least one suction opening disposed downstream, relative to the rotation of said rotor, of said outlet opening of said fiber supply duct and which opens into said chamber, whereby an airstream directed in the same direction as the rotation of said rotor is generated from said outlet opening to said at least one suction opening.

2. An open-end spinning unit according to claim 1, in which at least one said suction opening is obliquely positioned so as to oppose the direction of rotation of said rotor.

3. An open-end spinning unit according to claim 2, in which said at least one suction opening is positioned in such a manner that a tangent in the rotational direction of said rotor at at least one said suction opening to an imaginary circle makes an acute angle relative to an axis of said at least one suction opening, said imaginary circle passing on said at least one suction opening and being coaxial with said rotor.

4. An open-end spinning unit according to claim 1, in which at least one said suction opening is remote from said outlet opening by an angular distance of more than 45 degrees in the rotational direction of said rotor.

5. An open-end spinning unit according to claim 1, in which said outlet opening of said fiber supply duct and at least one said suction opening are provided on a side wall of a projected portion of said closing element.

6. An open-end spinning unit according to claim 1, in which at least one said suction opening is provided on a top wall of a projected portion of said closing element.

7. An open-end spinning unit according to one of claims 1 through 6, in which said unit is a forced-exhaustion type of unit.

8. An open-end spinning unit according to one of claims 1 through 6, in which said unit is a self-exhaustion type of unit.

9. An open-end spinning unit according to one of claims 1 through 6, in which said unit is a combination type unit of a forced-exhaustion and a self-exhaustion.

* * * * *